United States Patent [19]

Solomon

[11] 4,354,958

[45] Oct. 19, 1982

[54] FIBRILLATED MATRIX ACTIVE LAYER FOR AN ELECTRODE

[75] Inventor: Frank Solomon, Great Neck, N.Y.

[73] Assignee: Diamond Shamrock Corporation, Dallas, Tex.

[21] Appl. No.: 202,578

[22] Filed: Oct. 31, 1980

[51] Int. Cl.[3] ..... C25B 11/06; C25B 11/02

[52] U.S. Cl. ..... 252/425.3; 204/294; 429/42

[58] Field of Search ..... 429/42; 204/294; 252/425.3

[56] References Cited

U.S. PATENT DOCUMENTS

| | | | |
|---|---|---|---|
| 3,385,780 | 5/1968 | Feng | 204/294 |
| 3,409,474 | 11/1968 | Jung et al. | 429/42 |
| 3,462,307 | 8/1969 | Voorhies et al. | 429/42 X |
| 3,838,064 | 9/1974 | Vogt et al. | 252/384 |
| 3,838,092 | 9/1974 | Vogt et al. | 260/33.6 F |
| 3,935,029 | 1/1976 | Baker et al. | 429/42 |
| 4,058,482 | 11/1977 | Baris et al. | 252/425.3 |
| 4,150,076 | 4/1979 | Baris et al. | 264/49 |
| 4,170,540 | 10/1979 | Lazarz et al. | 204/296 |

FOREIGN PATENT DOCUMENTS

| | | |
|---|---|---|
| 1222172 | 2/1971 | United Kingdom . |
| 1284054 | 8/1972 | United Kingdom . |

OTHER PUBLICATIONS

Iliev, I., *Journal of Power Sources,* "On the Effect on Various Active Carbon Catalysts on the Behavior of Carbon Gas Diffusion Air Electrodes: 1. Alkaline Solutions," vol. 1, pp. 35–46, 1976/1977.

Landi, H. P., et al., "Advances in Chemistry Series," American Chemical Society Publications, pp. 13–23, 1969.

*Primary Examiner*—F. Edmundson

*Attorney, Agent, or Firm*—John P. Hazzard; Woodrow W. Ban

[57] ABSTRACT

The present disclosure is directed to an improved fibrillated matrix-type active layer for an electrode of improved strength and durability and capable of operation at high current density with enhanced resistance to mechanical failure, and to a process for producing such improved active layers. The process is characterized by alternately or simultaneously producing two components; combining the components; shear blending (fibrillating) the mixture; drying; chopping to a fine powder form, and rolling into a self-sustaining, coherent shear form. Alternatively, the active layer can be formed by wet deposition of the powder on a filter paper or like medium.

The term "matrix" as used herein means that the active carbon particles are present within an unsintered network of carbon black/PTFE (fibrillated) material.

5 Claims, No Drawings

FIBRILLATED MATRIX ACTIVE LAYER FOR AN ELECTRODE

BACKGROUND OF THE INVENTION

In the field of electrochemistry there is a well known electrochemical cell known as a chlor-alkali cell. In this cell, an electric current is passed through a saturated brine (sodium chloride salt) solution to produce chlorine gas and caustic soda (sodium hydroxide). A large portion of the chlorine and caustic soda for the chemical and plastics industries are produced in chlor-alkali cells.

Such cells are divided by a separator into anode and cathode compartments. The separator characteristically can be a substantially hydraulically impermeable membrane, e.g., a hydraulically imperable cation exchange membrane such as the commercially available NAFION® manufactured by the E. I. du Pont de Nemours & Company. Alternatively, the separator can be a porous diaphragm, e.g., asbestos which can be in the form of vacuum deposited fibers or asbestos paper sheet as are well known in the art. The anode can be a valve metal, e.g., titanium, provided with a precious metal coating to yield what is known in the art as a dimensionally stable anode.

One of the unwanted byproducts present in a chloralkali cell is hydrogen which forms at the cell cathode. This hydrogen increases the power requirement for the overall electrochemical process and eliminating its formation is one of the desired results in chlor-alkali cell operation.

It has been estimated that 25% of the electrical energy required to operate a chlor-alkali cell is utilized due to the formation of hydrogen at the cathode. Hence, the prevention of hydrogen formation at the cathode during the formation of hydroxide, can lead to substantial savings in the cost of electricity required to operate the cell. In fairly recent attempts to achieve cost savings and energy savings in respect of operating chlor-alkai cells, attention has been directed to various forms of what are known as oxygen (air) cathodes. These cathodes prevent the formation of molecular hydrogen at the cathode and instead reduce oxygen to form hydroxyl ions. Savings in cost for electrical energy are thereby achieved.

One known form of oxygen (air) cathode involves use of an active layer containing porous active carbon particles whose activity in promoting the formation of hydroxide may or may not be catalyzed (enhanced) using precious metal catalysts, such as silver, platinum, etc. The active carbon particles may become flooded with the caustic soda thereby significantly reducing their ability to catalyze the reduction of oxygen at the air cathode, resulting in decreased operating efficiency. In an attempt to overcome these difficulties in flooding of the active carbon, hydrophobic materials, e.g., polytetrafluoroethylene (PTFE) have been employed in particulate or fibrillated (greatly attenuated and elongated) form to impart hydrophobicity to the active carbon layer, per se, and/or to a protective (wet proofing) or backing sheet which can be laminated or otherwise attached to the active layer. Thus PTFE has been employed in both active layers and in backing (wetproofing) layers secured thereto. Such active carbon-containing layers, however, are subjected to loss of strength resulting in failure combined with blistering thereof when the chlor-alkali cell is operated at high current densities, viz., current densities ranging from about 250 milliamperes/cm$^2$ and higher for prolonged time periods.

FIELD OF THE INVENTION

The present invention is particularly directed to an improved fibrillated matrix air electrode and a process for forming it such that the resulting coherent, self-sustaining sheet can be subsequently employed as the active layer when laminated to a backing sheet and current collector to form an oxygen (air) cathode having high durability and resistance to degradation due to the corrosive environment present in a chlor-alkali cell, fuel cell, etc. In other words, the fibrillated, matrix active layer produced in accordance with this invention is capable of long life with a lower rate of decline in operating voltage. The term matrix is employed herein in as much as it is believed that in an electrode of this type the catalyzed active carbon is thoroughly involved with assisting the reduction of oxygen within the cathode active layer while the carbon black and the PTFE act in one or more ways; (a) as a hydrophobic gas path, (b) as a conductive agent, which lowers the electrical resistance of the mixture from about 2 to 3 times, resulting in a better current distribution to the current collector, and (c) as a hydrophobic binder, incorporating the wet active carbon in a matrix of Teflon carbon black. Of course, however, the present invention is not dependent upon this or any theory for the operation thereof.

PRIOR ART

U.S. Pat. No. 3,838,064 to John W. Vogt et al is directed to a process for dust control involving mixing a finely divided fibrillatable polytetrafluoroethylene with a material which characteristically forms a dust to form a dry mixture followed by sufficient working to essentially avoid dusting. Very small concentrations of PTFE, e.g., from about 0.02 to about 3% by weight are applied to achieve the dust control. Corresponding U.S. Pat. No. 3,838,092 also to Vogt et al is directed to dustless compositions containing fibrous polytetrafluoroethylene in concentrations of about 0.02% to less than 1%, e.g., about 0.75% by weight of PTFE based on total solids. The active layers of this invention are readily distinguishable from both the John W. Vogt et al. patents (U.S. Pat. Nos. 3,838,064 and 3,838,092) which employ much lower concentrations of PTFE and for different purposes.

Additionally, British Pat. No. 1,222,172 discloses use of an embedded conductive metal mesh or screen (35) within a formed electrode (30) containing a particulate matrix (34) of polytetrafluoroethylene polymer particles (21) in which there are located dispersed electrically conductive catalyst particles (24) which can be silver-coated nickel and silver-coated carbon particles, viz., two different types of silver-coated particles in the PTFE particulate matrix, in an attempt to overcome an increase in resistance as silver is consumed in the gas diffusion fuel cells to which said British patent is directed.

U.S. Pat. No. 4,058,482 discloses a sheet material principally comprised of a polymer such as PTFE and a pore-forming material wherein the sheet is formed of co-agglomerates of the polymer and the pore former. This patent teaches mixing polymer particles with positively charged particles of a pore former, e.g., zinc oxide, to form co-agglomerates thereof followed by mixing same with a catalyst suspension so as to form co-agglomerates of catalyst and polyerm-pore- former agglomerates followed by pressing, drying, and sintering these co-agglomerates. Subsequent to this sintering, the pore former can be leached out of the electrodes.

U.S. Pat. No. 4,150,076 (a division of U.S. Pat. No. 4,058,482) is directed to the process for forming the sheet of U.S. Pat. No. 4,058,482, said process involving formation of polymer-pore-former co-agglomerates, distributing same as a layer on a suitable electrode support plate, for example a carbon paper, to form a fuel cell electrode by a process which includes pressing, drying, sintering, and leaching.

U.S. Pat. No. 4,170,540 to Lazarz et al discloses microporous membrane material suitable for electrolytic cell utilization, e.g., as a chlor-alkali cell separator, and formed by blending particulate polytetrafluoroethylene, a dry pore-forming particulate material, and an organic lubricant. These three materials are milled and formed into a sheet which is rolled to the desired thickness, sintered, and subjected to leaching of the pore-forming material. According to the present invention, when forming the sheet by passing the fibrillated mixture of PTFE carbon black with active carbon and with or without a fugitive particulate pore-forming agent through the rollers, special care is taken to avoid conditions which would cause the PTFE to sinter. The present invention is clearly distinguishable from U.S. Pat. No. 4,170,540, which contains no active carbon and does not function as a catalytic or active layer in an electrode.

British Pat. No. 1,284,054 is directed to forming an air- breathing electrode containing an electrolyte within an air-depolarized cell. This air-breathing electrode is made by hot pressing a fluoropolymer sheet containing a pore-forming agent on to a catalyst composition (containing silver) and a metallic grid member. According to page 3 of said British patent, the PTFE-pore-forming agent-paraffin wax containing sheet, is subjected to a solvent wash to remove the paraffin wax (lubricant and binder) and then sintered in a sintering furnace at the appropriate temperatures for sintering the fluorocarbon polymer. After the PTFE-containing sheet is sintered and while it still contains the pore-forming particles, it is then ready for application to the catalyst composition of the air electrode for the hot pressing operation. Hot pressing involves the use of pressures ranging from about 5,000 to about 30,000 psi in conjunction with temperatures ranging from about 200° F. to 400° F. The process of the present invention is readily distinguishable from British Pat. No. 1,284,054 in that the present invention avoids the use of wax, avoids the trouble and expense of removing the wax and does not use sintering thereby imparting greater porosity to the PTFE in fibrillated form in the finished electrode. Additionally, the present invention avoids the repeated stripping-folding over-rolling again procedures required in all the examples of British Pat. No. 1,284,054.

U.S. Pat. No. 3,385,780 to I-Ming Feng discloses a thin, porous electrode consisting of a thin layer of a polytetrafluoroethylene pressed against a thin layer of polytetrafluoroethylene containing finely divided platinized carbon, the platinum being present in amounts of 1.2 to 0.1 mg/cm$^2$ in the electrically conductive face of the thin electrode, viz., the side containing the platinized carbon, viz., the active layer. A thermally decomposable filler material can be used, or the filler can be a material capable of being leached out by either a strong base or an acid. U.S. Pat. No. 3,385,780 also mentions a single unit electrode involving finely divided carbon in mixture with PTFE.

An article entitled "ON THE EFFECT ON VARIOUS ACTIVE CARBON CATALYSTS ON THE BEHAVIOR OF CARBON GAS-DIFFUSION AIR ELECTRODES":

1. "Alkaline Solutions " by I. Iliev et al appearing in the Journal of Power Sources, 1 (1976/1977) 35,46 Elsevier Sequoia S.A., Lausanne—printed in The Netherlands, at pages 35 to 46 of said Journal is directed to double-layer, fixed-zone Teflon-bonded carbon electrodes having a gas supplying layer of carbon black "XC-35" (not further defined by the author) wetproofed with 35% Teflon and an active layer consisting of a 30 mg/cm$^2$ mixture of the same wetproofed material "XC-35" and active carbon (weight ratio of 1:2.5). These electrodes were sintered at 350° C. under pressure of 200 kg/cm$^2$ and employed as oxygen (air) cathodes in alkaline test environments.

The present invention is readily distinguishable from the oxygen (air) cathodes of Iliev et al in that according to this invention, a strong unsintered active layer is obtained by a procedure whereby two components are separately formed, mixed, chopped, fibrillated and formed to a coherent, self-sustaining active layer sheet wherein the active carbon particles are present within an unsintered network of fibrillated carbon black-PTFE. Such sheets, after pressing to consolidate the material, have a tensile strength characteristically exceeding 100 psi and yield a matrix electrode having an unusual combination of high tensile strength with resistance to blistering under high current densities in use. It will be observed the conditions employed in formation of the two separately formed mixtures and fibrillation are insufficient to effect sintering of the PTFE contained in said matrix electrode. The Iliev et al electrodes made according to the description set forth in the experimental disclosure of Iliev et al obtain their strength by sintering under pressure, which this invention avoids, because sintering under pressure would adversely affect the porosity of the PTFE backing layer when laminated to an active layer and a current distributor to form an electrode. The active layer of this invention is suitably strengthened by fibrillation of the PTFE carbon mix and subsequently by pressing during electrode lamination.

The publication "Advances in Chemistry Series," copywright 1969, Robert F. Gould, (Editor), American Chemical Society Publications, contains at pages 13 to 23 an article entitled "A Novel Air Electrode" by H. P. Landi et al. The electrode described contains 2 to 8 percent PTFE, is produced without sintering and is composed of graphitic carbon (ACCO Graphite) or metallized graphitic carbon particles blended with a PTFE latex and a thermoplastic molding compound to form an interconnected net work which enmeshes the filter particles. This blend is molded into a flat sheet and the thermoplastic is then extracted. The present process employs non-graphitic active carbons, significantly higher concentrations of PTFE in the active layer while avoiding the use of thermoplastic molding compound and avoiding the necessity to remove same. Also, the active layer of this invention is formed by rolling a prefibrillated granular mix and no molding step is necessary. No indication is given by Landi et al as to the stability and/or durability of their air electrode and no life testing or data is include in said article. British Pat.

No. 1,222,172 discloses use of an embedded conductive metal mesh or screen (35) within a formed electrode (30) containing a particulate matrix (34) of polytetrafluoroethylene polymer particles (21) in which there are located dispersed electrically conductive catalyst particles (24) which can be silver-coated nickel and silver-coated carbon particles, viz., two different types of silver-coated particles in the PTFE particulate matrix in an attempt to overcome an increase in resistance as silver is consumed in the gas diffusion fuel cells to which said British patent is directed.

BRIEF SUMMARY OF THE INVENTION

This invention is directed to an electrode active layer comprising active carbon particles present within an unsintered network (matrix) of fibrillated carbon black-polytetrafluorethylene. The active carbon particles preferably contain silver or platinum and range in size from about 1 to 30 microns. The unsintered network (matrix) contains from about 25 to 35 weight parts of polytetrafluoroethylene and about 75 to 65 weight parts of carbon black having a surface area ranging from about 25 to 300 $m^2$ per gram and particle sizes ranging from about 50 to 3000 angstroms. The active layer contains a pore-forming agent and the concentration of active carbon therein ranges from about 40 to 80 weight percent.

DESCRIPTION OF THE INVENTION

One stream (mixture), the matrixing mix component, is obtained by adding a dilute dispersion containing polytetrafluoroethylene (PTFE) e.g., duPont "Teflon 30" having a particle size of about from 0.05 to 0.5 microns in water to a mix of a carbon black, e.g., an acetylene black, and water in a weight ratio of from about 25 to 35 weight parts of PTFE to from about 65 to about 75 weight parts of carbon black to "Teflonate" the carbon black, viz., form an intimate mix of PTFE/-carbon black particles; drying the aforementioned mixture and heat treating it to remove the PTFE wetting agent thereby resulting in a first component mix.

The second component, the active carbon-containing catalyst component, is comprised of an optionally catalyzed, preferably previously deashed and optionally particle size classified active carbon, having a particle size ranging from about 1 to about 30 microns and more usually from about 10 to about 20 microns.

Deashing can be done by pretreatment with caustic and acid to remove a substantial amount of ash from the active carbon prior to catalyzing same. The term ash refers to oxides principally comprised of silica, alumina, and iron oxides. The deashing of active carbon constitutes the subject matter of co-pending U.S. Patent application entitled "Active Carbon Conditioning Process," Ser. No. 202,580, filed on even date herewith in the name of Frank Solomon as inventor. The disclosure of this application is incorporated herein by reference. The thus deashed, classified, active carbon particles can then be catalyzed with a precious metal, e.g. by contacting with a silver or platinum precursor followed by chemical reduction with or without heat to deposit silver, platinum or other respective precious metal on the active carbon. The catalyzed carbon can be filtered, dried at temperatures ranging from about 80° C. to 150° C., with or without vacuum, to produce a second (active carbon catalyst) component or mixture.

These mixtures are then chopped together, with or without the addition of a particulate, subsequently removable (fugitive) pore-forming agent and then shear blended (fibrillated) at temperatures ranging from about 40° to about 60° C. for 2 to 10 minutes, e.g. 4 to 6 minutes in the presence of a processing aid or lubricant, e.g., a 50:50 mixture (by weight) of isopropyl alcohol and water, viz., when no pore former is used as bulking agent. When a water-soluble pore former is used, the lubricant can be isopropyl alcohol. The previously chopped mixture can be fibrillated using a mixer having a Sigma or similar blade. During this fibrillation step, the chopped mixture of the two-component mixes is subjected to shear blending forces, viz., a combination of compression and attenuation which has the effect of substantially lengthening the PTFE in the presence of the remaining components. This fibrillation is believed to substantially increase the strength of the resulting sheets formed from the fibrillated mixed components. After such fibrillating, the mixture is noted to be fibrous and hence, the term "fiberizing" is used herein as synonymous with fibrillating.

Subsequent to fibrillation, the mixture is dried, chopped for from one to ten seconds into a fine powder and formed into a sheet by rolling at 50° to 100° C. or by deposition on a filter. A pore-former, if one is employed as a bulking agent, can be then removed prior to electrode fabrication. In the event no pore former is employed, the matrix active layer sheet can be used (as is) as the active catalyst-containing layer of an oxygen (air) cathode, e.g., for use in a chlor-alkali cell, fuel cell, etc.

The present invention is based upon the discovery that the aforementioned blistering and structural strength problems encountered at high current densities in active layers of gas electrodes can be substantially overcome by a process involving: forming two separate components, one a matrixing mix component containing carbon black with polytetrafluoroethylene particles and heating treating this PTFE-carbon black mix at given temperature conditions; separately forming an active carbon-containing/catalyst component; combining these two separate components into a mix; chopping the mix and shear-blending the chopped mix (fibrillating same) in order to arrive at a readily formable matrix which can be formed, e.g., pressed between rolls, or deposited upon a filter paper as a forming medium, pressed and then used as the active layer in an oxygen (air) cathode. The present invention results in active layers having reduced carbon corrosion, higher conductivity and air-transport combined with strength when compared with prior structures. This results in electrodes which can be used longer and are more stable in use.

Tensile strength tests of the coherent, self-sustaining active layer sheets rolled from the fiberized material characteristically displayed approximately 50% greater tensile strength than unfiberized sheets. Life testing of electrodes employing the fibrillated (fiberized) active layer sheets of this invention resulted in approximately 8900 hours life at 300 milliamps/$cm^2$ in 30% hot (60° to 80° C.) aqueous sodium hydroxide before failure. In addition to the advantages of longevity and strength, this process is easy to employ in making large batches of active layer by continuous rolling of the fibrillated mix resulting in a material uniform in thickness and composition. Furthermore, the process is easy to administer and control.

In accordance with one preferred embodiment of this invention, a water soluble pore-forming agent, e.g., sodium carbonate, is employed in the mixing step wherein the polytetrafluoroethylene dispersion is mixed with carbon black. Alternatively, the pore-forming agent can be added later, when the carbon black-PTFE mix and the catalyzed active carbon particles are mixed together and chopped.

In forming an initial mixture of carbon black and polytetrafluoroethylene, the usual particle size of the carbon black ranges from about 50 to about 3000 angstroms and it has a surface area ranging from about 25 to about 300 $m^2$/gram. The PTFE is preferably employed in aqueous dispersion form and the mixture of carbon black and polytetrafluoroethylene can contain from about 65 to about 75 weight parts of carbon black and about 35 to about 25 weight parts of PTFE. After mixing, the carbon black and PTFE are dried and then the dried initial mix is heated in air at temperatures ranging from about 250° to 325° C., and more preferably 275° to 300° C., for time periods ranging from 10 minutes to 1.5 hours and more preferably from 20 minutes to 60 minutes. This heating removes the bulk of the PTFE wetting agent.

The other component of the matrix electrode, viz., the active carbon, preferably "RB" carbon manufactured by Calgon, a division of Merck, is deashed as per Docket 3194 by contact with an aqueous alkali, e.g., sodium hydroxide, or equivalent alkali, and more usually aqueous sodium hydroxide having a sodium hydroxide concentration of about 28 to about 55 wt. % for 0.5 to 24 hours. After washing, the active carbon is then contacted with an acid, which can be hydrochloric acid, phosphoric acid, sulfuric acid, hydrobromic acid, etc., at ambient temperatures using aqueous acid solution having from about 10 to about 30 wt. % acid, based on total solution for comparable time periods. Subsequent to the contact with acid, the deashed active carbon particles are preferably catalyzed. The deashed particles are preferably catalyzed as by contact with a precursor of a precious metal catalyst. In the event that the silver is desired to be deposited within the pores of the active carbon, it is preferred to use silver nitrate as the catalyst precursor followed by removal of excess silver and chemical reduction with alkaline formaldehyde. This can be done as described and claimed in U.S. patent application Ser. No. 202,579 entitled "Process for Catalyst Preparation" filed of even date herewith in the name of Frank Solomon. The disclosure of this application is incorporated herein by reference.

On the other hand, in the event that it is desired to deposit platinum within the pores of the active carbon material, chloroplatinic acid can be used as a precursor followed by removal of excess chloroplatinic acid and chemical reduction using sodium borohydride or formaldehyde as a reducing agent. According to a preferred embodiment, the platinum is derived from $H_3Pt(SO_3)_2OH$ by the procedure set forth in U.S. Pat. No. 4,044,193. The reduction can be accompanied with the use of heat or it can be done at ambient room temperatures. After catalysis, the active carbon particles are filtered and vacuum dried as the active carbon-containing catalyst component in preparation for combination with the acetylene black PTFE matrixing component mix.

The carbon black/PTFE matrixing component mix preferably in a weight ratio ranging from about 65 to 75 weight parts of carbon black to 25 to 35 weight parts of PTFE, is mixed with the catalyzed deashed active carbon-containing component and subjected to chopping to blend the carbon black PTFE matrixing component with the catalyst component in the manner set forth above. This mix is then subjected to fibrillation (shear blending or fiberizing), for example in a mixer with appropriate blades at approximately 50° C. This shear blended material has a combination of good conductivity and high tensile strength with low Teflon content resulting in extraordinarily long life in use at high current densities in the corrosive alkaline environment present in a chlor-alkali cell.

The active layers of this invention can contain (after removal of any pore forming bulking agent therefrom) from about 40 to 80 wt. % of active carbon, the remainder being the matrixing materials, carbon black and PTFE.

Subsequent to the fibrillation step, the fibrillated material is dried, chopped and rolled at approx. 75° C. yielding the resulting coherent, self-sustaining and comparatively high tensile strength active layer sheet. Active carbon-containing active layer sheets produced in accordance with this invention characteristically have thicknesses of 0.010 to 0.025 inches (10 to 25 mils) with corresponding tensile strengths ranging from about 75 to 150 psi (measured after pressing in a hydraulic press at $8\frac{1}{2}$ T/$in^2$ and 112° for three minutes).

The invention will be illustrated in further detail in the examples which follow in which all percents, ratios and parts are by weight unless otherwise indicated.

EXAMPLE 1

(A matrix active layer containing silver catalyzed active carbon particles.)

Commercially available ball milled "RB carbon" was found to have an ash content of approximately 12% as received. This "RB carbon" was treated in 38% KOH for 16 hours at 115° C. and found to contain 5.6% ash content after a subsequent furnace operation. The alkali treated "RB carbon" was then treated (immersed) for 16 hours at room temperature in 1:1 aqueous hydrochloric acid (20% concentration). The resulting ash content had been reduced to 2.8%. "RB carbon, deashed as above, was silvered in accordance with the following procedure:

Twenty (20 g) grams of deashed "RB carbon" were soaked in 500 ml of 0.161 N (normal) aqueous $AgNO_3$ with stirring for two hours; the excess solution was filtered off to obtain a filter cake. The retrieved filtrate was 460 ml of 0.123 N $AgNO_3$. The filter cake was rapidly stirred into an 85° C. alkaline formaldehyde solution, prepared using 300 cc (cubic centimeters) water, and 30 cc of 30% aqueous NaOH and 22 cc of 37% aqueous $CH_2O$, to ppt. Ag in the pores of the active carbon.

Calculation indicated that 79% of the 2.58 grams of retained silver in the catalyst was derived from adsorbed silver nitrate.

Separately, "Shawinigan Black," a commercially available acetylene carbon black, was teflonated with "Teflon 30" (duPont polytetrafluoroethylene dispersion), using an ultrasonic generator to obtain intimate mixture. 7.2 grams of the dried carbon black/PTFE mix was high speed chopped, spread in a dish, and then heat treated at 525° F. for 20 minutes. Upon removal and cooling, it was once again high speed chopped, this time for 10 seconds. Then 18 grams of the classified silvered active carbon was added to the 7.2 grams of carbon black-Teflon mix, high speed chopped for 15 seconds, and placed into a fiberizing (fibrillating) apparatus. The apparatus used for fiberizing consists of a Brabender Prep Center, Model D101, with an attached measuring head REO-6 on the Brabender Prep Center and medium shear blades were used. The mixture was added to the cavity of the mixer using 50 cc of a 30/70 (by volume) mixture of isopropyl alcohol in water as a lubricant to aid in fibrillating. The mixer was then run for 5 minutes at 30 rpm at 50° C., after which the material was removed as a fibrous coherent mass. This mass was then oven dried in a vacuum oven and was high speed chopped in preparation for rolling.

The chopped particulate material was then passed through a rolling mill, a Bolling rubber mill. The resulting matrix active layer sheet had an area density of 22.5 milligrams per square centimeter and was ready for lamination.

EXAMPLE 2

(A matrix active layer containing platinum catalyzed active carbon particles)

The procedure of Example 1 was repeated except that platinum was deposited on the deashed active ("RB") carbon instead of silver. The 10 to 20 micron classified deashed "RB" carbon had platinum applied thereto in accordance with the procedure described in U.S. Pat. No. 4,044,193 using $H_3Pt(SO_3)_2OH$ to deposit 1 wt. part platinum per 34 weight parts of deashed active carbon.

After fibrillation and upon rolling, the area density of the active layer was determined to be 22.2 milligrams per $cm^2$. This matrix active layer was then ready for lamination.

EXAMPLE 3

(A matrix active layer containing silver catalyzed active carbon particles without heat treatment before fibrillation)

An active layer containing deashed, silvered "RB" active carbon was prepared as in Example 1 with the exception that the 70/30 (by weight) "Shawinigan Black/"Teflon 30" matrixing material was not heat treated before fabrillating. This matrix active layer was heavier than those prepared according to Examples 1 and 2. It had an area density of 26.6 milligrams per $cm^2$ and was ready for lamination.

EXAMPLE 4

(A matrix active layer containing platinum catalyzed active carbon particles incorporating a pore former and heat treated, as in Examples 1 and 2, before fibrillation)

This matrix active layer was made according to the basic procedure of Example 1 using deashed "RB" active carbon platinized by the method of U.S. Pat. No. 4,044,193 to a level of 19 weight parts of deashed "RB" active carbon per weight part platinum. Six grams of ultrasonically teflonated (70:30, "Shawinigan Black":PTFE) carbon black were heat treated for 20 minutes at 525° F. prior to addition thereto of 15 grams of said active carbon along with 9 grams of sodium carbonate in isopropanol, which had been classified to the particle size range of +5 to −10 microns. This material was fibrillated and rolled out as in Example 1 and extracted by water (to remove the sodium carbonate) after first hot soaking it in ethylene glycol at 75° C. for 20 minutes.

The resulting active layer sheet was a very porous and light weight material.

EXAMPLE 5

(Forming laminated electrodes from the matrix active layers of Examples 1-3 and testing them in alkaline media at current densities of 250 milliamperes per square centimeter and higher.)

The active layers prepared in accordance with Examples 1 to 3, respectively, were each laminated to a current distributor and a backing sheet of sodium carbonate-loaded PTFE prepared as follows:

Two hundred cubic centimeters of isopropyl alcohol were poured into an "Osterizer" blender. Then 49 grams of duPont 6A polytetrafluoroethylene were placed in the blender and the PTFE—alcohol dispersionwas blended at the "blend" position for approximately one minute. The resulting slurry had a thick pasty consistency. Then another 100 cc of isopropyl alcohol were added in the blender and the mixture was blended (again at the "blend" position) for an additional two minutes.

Then 91 grams of particulate sodium carbonate in isopropanol (Ball milled and having an average particle size of approximately 3.5 microns, as determined by a Fisher Sub Sieve Sizer) were added to the blender. The PTFE—sodium carbonate mixture was then blended at the "blend" position in the "Osterizer" blender for three minutes followed by a higher speed blending at the "liquefying" position for an additional one minute. The resulting PTFE—sodium carbonate slurry was then poured from the blender on to a Buchner funnel and filtered and then placed in an oven at 80° C. where it was dried for three hours resulting in 136.2 grams yield of PTFE—sodium carbonate mixture. This mixture contained approximately 35 weight parts of PTFE and 65 weight parts of sodium carbonate.

This mixture was mildly fibrillated a Brabender Prep Center with attached Sigma mixer as described above.

After fibrillating, which compresses and greatly attenuates the PTFE, the fibrillated material is chopped to a fine dry powder using a coffee blender, i.e., Type Varco, Inc. Model 228.1.00 made in France. Chopping to the desired extent takes from about 5 to 10 seconds because the mix is friable. The extent of chopping can be varied as long as the material is finely chopped.

The chopped PTFE—$Na_2CO_3$ mix is fed to six inch diameter chrome-plated steel rolls heated to about 80° C. Typically these rolls are set at a gap of 0.008 inch (8 mils) for this operation. The sheets are formed directly in one pass and are ready for use as backing layers in forming electrodes, e.g., oxygen cathodes, with no further processing beyond cutting, trimming to size and the like.

The current distributors had the below tabulated diameter and were nickel woven wire mesh having a 0.0003 inch thick silver plating and the woven strand arrangement tabulated below. The distributor was positioned on one active layer side while the backing layer was placed on the other side of the active layer.

The lamination was performed in a hydraulic press at 100° to 130° C. and using pressures of 4 to 8.5 tons per $in^2$ for several minutes. These laminates were then hot soaked in ethylene glycol at 75° C. for 20 minutes before water washing at 65° C. for 18 hours. They were then dried.

The laminates were then placed in respective half cells for testing against a counter electrode in thirty percent aqueous sodium hydroxide at temperatures of 70° to 80° C. with an air flow of four times the theoretical requirement for an air cathode and at a current density of 300 milliamperes per $cm^2$. The testing results and other pertinent notations are given below.

TABLE 1

| Active Layer Example | Type of Ag Plated Ni Mesh | Initial Voltage us. Hg/Hg/O Ref. Electrode | Useful Life of Matrix Electrode (hrs) | Voltage at Failure |
|---|---|---|---|---|
| 1 | 58 × 60 × .004 | −0.265 volts | 8,925 | −.395 volts(1) |
| 2 | 50 × 50 × .005 | −0.201 volts | 3,512+ | N.A.(2) |
| 3 | 58 × 60 × .004 | −0.282 volts | 3,861 | −.509 volts(3) |

(1)Shortly after 8925 hours there was a steep decline in potential and the electrode was judged to haved failed.
(2)After 188 days, its voltage was −0.246 volts compared to the Hg/HgO reference electrode (a very slight decline in potential) and this matrix electrode is still on life testing. After being started at 300 milliamperes per $cm^2$, the test current density was changed to 250 milliamperes/$cm^2$.
(3)The final failure was caused by separation of the current distributor from the face of the electrode.

It should be noted here that in each of these "matrix" electrodes the approximate concentration of PTFE in the active layer mix is only about twelve (12) percent by weight. Prior to the "matrix" active layers of this invention, PTFE concentrations in active layers of approximately 20% were usually considered mandatory to obtain satisfactory electrodes. For example, prior to this invention PTFE concentrations in active layers of below about 18 wt. % yielded completely unsatisfactory electrodes. Hence it will be recognized that the "matrix" active layers of this invention enable considerably less Teflon to be used while still achieving the combined requirements of conductivity, strength, permeability and longevity long sought in air breathing electrodes.

What is claimed is:

1. A method of preparation of matrix active layer for an electrode comprising intimately mixing carbon black particles having a particle size of from about 50 to about 3000 Angstroms and having a surface area of from about 25 to about 300 square meters per gram, with an aqueous dispersion of fibrillatable polytetrafluoroethylene particles; said mixture containing from 65 to about 75 percent carbon black particles and 25 to 35 percent polytetrafluoroethylene by weight; drying said mixture at temperatures in the range from about 250° to 325° C. from 10 to about 90 minutes; combining the thus dried PTFE/carbon black particulate component with deashed active carbon catalyst particles to form an intimate mix said catalyst particles amounting from between 40 to 80 weight percent of the entire mix; fibrillating said intimate mix and forming said fibrillated mixture into an active layer containing active carbon particles present within a network of carbon black and fibrillated polytetrafluoroethylene.

2. A method as in claim 1 wherein said carbon black is an acetylene black.

3. A method as in claim 1 wherein said active carbon particles contain platinum.

4. A method as in claim 1 wherein said active carbon particles range in size from about 1 to about 30 microns.

5. A method as in claim 1 wherein the total mix contains from about 25 to about 50 weight percent of a pore-forming bulking agent.

* * * * *

UNITED STATES PATENT AND TRADEMARK OFFICE

CERTIFICATE OF CORRECTION

PATENT NO. : 4,354,958

DATED : October 19, 1982

INVENTOR(S) : Frank Solomon

It is certified that error appears in the above-identified patent and that said Letters Patent are hereby corrected as shown below:

In column 11, Table I, line 2 of the heading, the word "us." should read --vs.--

Signed and Sealed this

First Day of February 1983

[SEAL]

*Attest:*

GERALD J. MOSSINGHOFF

*Attesting Officer*

*Commissioner of Patents and Trademarks*